US010933502B2

(12) United States Patent
Olsen

(10) Patent No.: US 10,933,502 B2
(45) Date of Patent: Mar. 2, 2021

(54) POLISHING SYSTEM AND A POLISHING TOOL COMPRISING SAID POLISHING SYSTEM

(71) Applicant: BECO HOLDING LIMITED, Mriehel (MT)

(72) Inventor: Kenneth Olsen, Sayalonga (ES)

(73) Assignee: BECO HOLDING LIMITED, Mriehel (MT)

( * ) Notice: Subject to any disclaimer, the term of this patent is extended or adjusted under 35 U.S.C. 154(b) by 0 days.

(21) Appl. No.: 16/754,731

(22) PCT Filed: Oct. 12, 2018

(86) PCT No.: PCT/IB2018/057913
§ 371 (c)(1),
(2) Date: Apr. 8, 2020

(87) PCT Pub. No.: WO2019/073445
PCT Pub. Date: Apr. 18, 2019

(65) Prior Publication Data

US 2020/0262022 A1 Aug. 20, 2020

(30) Foreign Application Priority Data

Oct. 13, 2017 (DK) ..... PA 2017 00583

(51) Int. Cl.
*B24B 7/18* (2006.01)
*B24B 7/22* (2006.01)
(Continued)

(52) U.S. Cl.
CPC ..... *B24B 7/186* (2013.01); *B24B 7/22* (2013.01); *B24B 41/047* (2013.01); *B24B 45/006* (2013.01); *B24D 7/066* (2013.01)

(58) Field of Classification Search
CPC ..... B24B 7/186; B24B 7/22; B24B 41/047; B24B 45/006
(Continued)

(56) References Cited

U.S. PATENT DOCUMENTS 1,430,214 A * 9/1922 Carrie ..... B24B 41/047 451/271
1,933,846 A 11/1933 Finnell
(Continued)

FOREIGN PATENT DOCUMENTS

DK 201500078 U4 10/2016
EP 2723532 A 4/2014
(Continued)

OTHER PUBLICATIONS

International Search Report Appl. No. PCT/IB2018/057913 dated Feb. 1, 2019.
(Continued)

*Primary Examiner* — George B Nguyen
(74) *Attorney, Agent, or Firm* — Winston & Strawn LLP

(57) ABSTRACT

The present invention relates to a polishing system (100) for providing a polishing finish to a concrete surface, said system comprises a pad lock (2) which, one a second surface (6) thereof, comprises a number of protrusions (32) which are able to enter into engagement with a voids (16) arranged on a first surface (12) of a pad (10) placed between a fixing ring and said pad lock. The use of such a system provides a higher degree of integrity during use of said polishing system.

28 Claims, 5 Drawing Sheets

(51) Int. Cl.
*B24B 41/047* (2006.01)
*B24B 45/00* (2006.01)
*B24D 7/06* (2006.01)

(58) Field of Classification Search
USPC ..... 451/353–359
See application file for complete search history.

(56) References Cited

U.S. PATENT DOCUMENTS 4,541,207 A 9/1985 Antonson
4,747,176 A * 5/1988 Parks ..... A47L 11/164 15/230.16
4,890,422 A * 1/1990 Reiling ..... B24D 9/08 451/342
5,619,770 A 4/1997 Bell
5,806,132 A * 9/1998 Kelley ..... A47L 11/164 15/230.17
5,944,586 A * 8/1999 Sevigny ..... B24D 7/04 451/359
6,234,886 B1 * 5/2001 Rivard ..... A47L 11/164 451/353
6,261,164 B1 * 7/2001 Rivard ..... A47L 11/164 451/353
8,272,924 B2 * 9/2012 Van Eijden ..... B24D 7/066 451/56
9,695,606 B1 * 7/2017 Allen, Jr. ..... A47L 11/4038
2002/0022444 A1 * 2/2002 Littlefield ..... B24B 23/00 451/353
2003/0022612 A1 1/2003 Barnes et al.
2008/0072386 A1 3/2008 Kelley
2009/0190099 A1 7/2009 Copoulos
2010/0120342 A1 * 5/2010 Rivard ..... B24D 9/085 451/359
2010/0261414 A1 * 10/2010 Fronek ..... B24D 15/04 451/28
2014/0227950 A1 8/2014 Ahonen
2016/0136772 A1 5/2016 Littlefield et al.

FOREIGN PATENT DOCUMENTS

WO WO2006027988 A1 3/2006
WO WO2017053737 A1 3/2017

OTHER PUBLICATIONS

International Preliminary Report on Patentability PCT/IB2018/057913 dated Feb. 6, 2020.

* cited by examiner

POLISHING SYSTEM AND A POLISHING TOOL COMPRISING SAID POLISHING SYSTEM

This application is a 371 filing of International Patent Application PCT/IB2018/057913 filed Oct. 12, 2018, which claims priority to PA 201700583 filed Oct. 13, 2017.

FIELD OF THE INVENTION

The present invention relates to improvement in the field of equipment for providing finish to concrete surfaces, especially for homes and offices and the like and in respect of industrial floors.

More specifically, the present invention in a first aspect relates to a polishing system for providing a polishing finish to a concrete surface. In a second aspect the present invention relates to a polishing tool comprising a polishing system according to the first aspect of the present. In a third aspect the present invention relates to a powered polishing machine comprising a polishing system according to the first aspect or comprising a polishing tool according to the second aspect of the present invention. In a fourth aspect the present invention relates to the use of a polishing system according to the first aspect, or of a polishing tool according to the second aspect or of a powered polishing machine according to the third aspect of the present invention for providing a polished finish to a concrete surface.

BACKGROUND OF THE INVENTION

Within the field of construction it has for many decades been customary to cast floors and other surfaces in concrete.

Further, in recent years it has been popular to provide such concrete surfaces with a polished finish having a very smooth and shining surface. This is especially the case with regard to rooms in homes and offices, industrial floors and other business premises.

Such smooth and shining surfaces provide for an aesthetic appearance and they are at the same time easy to clean and maintain in a shining state.

In the construction of a concrete floor the concrete, upon curing and while still being wet, is subjected to a levelling process where machines having one or more floating pans are moved across the surface of the floor. Such machines are denoted power trowels. A power trowel may be hand held or may be controlled by an operator sitting on top thereof.

The machines and their rotating floating pans ensure that the concrete upon curing is leveled out, and that any air entrapped in the concrete, is allowed to rise to the surface.

After having been leveled out and after the concrete floor has been fully cured, the concrete surface may be subjected to a polishing process.

Recently, it has been found that power trowels also can be used for polishing concrete floor surfaces if said trowels are slightly modified. The modification comprises arranging a number of polishing discs in a polishing disc assembly which is configured to be connected to the rotating pans of the power trowel. Such system is e.g. disclosed in the Danish utility model No, DK 2015 00078 U4.

The polishing disc assembly disclosed in DK 2015 00078 U4 comprises a pad lock, a pad, a fixing ring and a number of polishing discs, which in that order are arranged and fixed on the surface of a floating pan of a power trowel. The various components of the disc assembly according to DK 2015 00078 U4 were fixed to each other by use of a number of splints.

Although the polishing disc assembly of DK 2015 00078 U4 provides for the ability of polishing a concrete surface to a smooth and shining surface, the polishing disc assembly in DK 2015 00078 U4 suffers from some disadvantages.

These disadvantages are that during prolonged use, the vigorously forces involved in polishing a concrete surface may result in some degree of disintegration of the polishing disc assembly, i.e. the components does not adhere firmly to each other. Other disadvantages encountered with this system are that the polishing discs are prone to become worn in an uneven way. Furthermore, the mounting and exchange of polishing discs have turned out to be difficult and time consuming. Moreover it was difficult to obtain an even grip on the pad causing in general an unstable grinding.

It is an objective of the present invention to provide a polishing system which reduces and/or even eliminates the above disadvantages.

BRIEF DESCRIPTION OF THE INVENTION

This objective is fulfilled with the present invention in its various aspects.

Accordingly, the present invention in its first aspect relates to a polishing system for providing a polishing finish to a concrete surface, said system, in the orientation intended for use when polishing a horizontal surface of a concrete material, such as a floor, comprising from top to bottom:

- a pad lock comprising a first surface and a second surface; said pad lock, at said first surface, being configured for being connected to a moving pan of a powered polishing machine;
- a pad comprising a first surface and a second surface, said first surface being configured to be contacted to said second surface of said pad lock, said pad being made of a resilient fibrous material comprising a number of voids accessible at a first surface thereof;
- a fixing ring comprising a first surface and a second surface, said fixing ring, at a first surface thereof, being configured to be contacted with said second surface of said pad;
- a number of polishing discs having a first surface and a second surface; wherein each said polishing discs at a first surface thereof is being configured for being connected to said fixing ring, at a second surface thereof; and wherein each polishing discs at a second surface thereof comprises polishing means; and
- wherein said pad lock at least at a part of said second surface thereof, comprises a number of protrusions which are able to enter into engagement with said voids of said first surface of said pad for securing the integrity of said system during use thereof in a polishing operation.

In this it is ensured that the different components of the polishing system according to the invention are effectively and securely connected to each other.

A second aspect the present invention relates to a polishing tool for providing a polishing finish to a concrete surface, said polishing tool comprises a polishing system according to the first aspect of the present invention in combination with a moving pan of a powered machine, e.g. a power trowel.

In a third aspect the present invention relates to a powered polishing machine, e.g. a power trowel, comprising a polishing system according to the first aspect of the present invention or comprising a polishing tool according to the second aspect of the present invention.

In a fourth aspect the present invention relates to a use of a polishing system according to the first aspect of the present invention, or of a polishing tool according to the second aspect of the present invention or of a powered polishing machine according to the third aspect of the present invention for providing a polished finish to a concrete surface.

The present invention in its various aspects provides for improved integrity during use for polishing a concrete surface and furthermore provides for easy and fast change or renewal of polishing discs.

Thereby can prolonged operation time of the system be ensured with easy and fast exchange of polishing discs. Furthermore, huge areas of surfaces can be polished using a power trowel. The special design of the pad lock makes the polishing system flexible, thus allowing movement over uneven surfaces and in general provides for a more stable grinding with enhanced integrity of the system. Further the inventive system provides for a smoother surface of the polished material.

DETAILED DESCRIPTION OF THE INVENTION

The present invention in its first aspect relates to a polishing system for providing a polishing finish to a concrete surface, said system, in the orientation intended for use when polishing a horizontal surface of a concrete material, such as a floor, comprising from top to bottom:

- a pad lock comprising a first surface and a second surface; said pad lock, at said first surface, being configured for being connected to a moving pan of a powered polishing machine;
- a pad comprising a first surface and a second surface, said first surface being configured to be contacted to said second surface of said pad lock, said pad being made of a resilient fibrous material comprising a number of voids accessible at a first surface thereof;
- a fixing ring comprising a first surface and a second surface, said fixing ring, at a first surface thereof, being configured to be contacted with said second surface of said pad;
- a number of polishing discs having a first surface and a second surface; wherein each said polishing discs at a first surface thereof is being configured for being connected to said fixing ring, at a second surface thereof; and wherein each polishing discs at a second surface thereof comprises polishing means;
- wherein said pad lock at least at a part of said second surface thereof, comprises a number of protrusions which are able to enter into engagement with said voids of said first surface of said pad for securing the integrity of said system during use thereof in a polishing operation, i.e. ensuring that the different components of the polishing system are effectively and securely connected to each other.

In order to increase the integrity of the system, the polishing system may in a preferred embodiment further comprise a number of connecting elements which is/are configured for connecting said pad lock and said pad and said fixing ring to a moving pan of powered polishing machine by penetrating through-going holes of said pad lock and said pad and said fixing ring. Thereby effectively preventing the polishing system from being disconnected from the moving pan during use, e.g. due to high rotational forces and the like.

The polishing system of the first aspect of the present invention is preferably intended to be used with a power trowel which is originally intended for levelling of wet concrete prior to curing thereof.

This is accomplished by arranging and fastening the various components of the system on the lower surface (in the orientation intended during use) of a floating pan of that power trowel in the following order from top to bottom: the pad lock, the pad, the fixing ring and finally the polishing discs. The whole assembly is subsequently fixed to the floating pan of the power trowel by means of the connection elements, however other ways of fixing the polishing system according to the invention to the floating pan is also contemplated within the scope of the present invention.

By providing the fixing ring with a number of protrusions on the second surface thereof, a better integrity of the system is ensured, where all components of the system will be thoroughly fixed to each other and yet still provides for some resilience for absorbing some of the violent forces encountered during a polishing process when the polishing system is used on a power trowel.

In one embodiment of the polishing system according to the first aspect of the present invention, said pad lock, said pad and said fixing ring are each having an outer perimeter defining a circle; preferably wherein said pad lock, said pad and said fixing ring each are having a perimeter defining a circle of essentially equal diameter. In such an embodiment a sturdy, simple and strong system is provided.

In a simple embodiment of the polishing system according to the first aspect of the present invention, said first surface of said pad lock and said first surface and said second surface of said fixing ring are each being planar, providing a even leveling of the floor.

In one embodiment of the polishing system according to the first aspect of the present invention said first surface of said pad lock and said first surface of said fixing ring each are exhibiting a concave curvature; and wherein said second surface of said pad lock and said second surface of said fixing ring each are exhibiting a convex curvature, preferably both the pad lock and the fixing ring are thicker near the periphery than near the center. This will ensure than in an assembled state the polishing tool will have a certain degree of flexibility, i.e. the pad lock will e.g. be able to absorb forces in the cavity provided between the first surface of the pad lock and the moving pan, and accordingly such planar and curved surfaces provides for an efficient polishing process during use of the system.

In one embodiment of the polishing system according to the first aspect of the present invention, said concave and said convex curvature independently are being rotational symmetrical, thereby e.g. ensuring that the polishing discs will not be unevenly worn.

In one embodiment of the polishing system according to the first aspect of the present invention, said pad lock is being manufactured from a material from the group comprising polypropylene and polyethylene.

In one embodiment of the polishing system according to the first aspect of the present invention, said pad is being manufactured from a material from the group comprising polyester, nylon, synthetic fibers and natural fibers.

In one embodiment of the polishing system according to the first aspect of the present invention, said fixing ring is being manufactured from a material from the group comprising polypropylene, polyethylene and EPDM (ethylene propylene diene monomer).

These types of materials discussed above have proven appropriate for the respective purposes, however other materials capable of meeting the different requirements of the respective components, e.g. the desired integrity, are also contemplated within the scope of the present invention In one embodiment of the polishing system according to the first aspect of the present invention, said second surface of said polishing discs comprises a polymer having embedded therein a number of diamonds, such as industrial diamonds.

In one embodiment of the polishing system according to the first aspect of the present invention, said polymer having diamonds embedded therein is selected from the group comprising: Bakelite, a copolymer powder, such as artificial metal powder; a metal alloy powder, such as iron alloy powder, such as iron alloy powder, copper alloy powder; or carbon alloy powder.

The content of the industrial diamonds in the polymer is preferably 1-60 vol %, such as 2-55 vol %, for example 10-vol %, e.g. 20-45 vol %. However the inventors of the present invention has found that by using polymers having a content of industrial diamonds of about 25-40, preferably 30-35 vol %, provides an especially advantageously embodiment.

Similar, a coarseness of said polishing discs may be selected from the grit sizes P50-P6000, such as P100-P3000, for example P200-P1000, for example P300-P600 or P400-P500, which have proven efficient for the intended purposes.

In one embodiment of the polishing system according to the first aspect of the present invention, the number of protrusions of said pad lock, at said second surface thereof is 100-20,000 or more, such as 500-15,000, for example 1,000-10,000, such as 2,000-5,000, depending on the extension and dimensions of said protrusions.

In one embodiment said protrusions may be evenly distributed on the second surface of the pad lock, at least at a part or at parts of said surface. It is however preferred that said pad lock, at said second surface thereof, comprises distinct and separated areas each comprising said protrusions. Placing the protections at distinct and separated areas ensures that the polishing system can be easily assembled, that said polishing system has the desired integrity during assembling and use, but also that said polishing system can be easily dismantled again. If for instance the protrusions are placed over the entire second surface of the pad lock, it can be difficult to separate said pad lock from the pad after use—however, this may also be preferred in some situations where a high integrity is desired.

In one embodiment of the polishing system according to the first aspect of the present invention, said protrusions on said second surface of said pad lock are distributed in a circular pattern, as this inventors of the present invention has found that this provides a highly advantageously embodiment, in which the desired integrity is provided and the system can still be assembled and dismantled without problems.

In order to provide a strong and coherent attachment of the padlock to the pad, the length of said protrusions of said pad lock may preferably, taken in a direction perpendicular to said second surface, independently be between 1-30 mm, such as 2-29 mm, for example 3-28 mm, e.g. 4-27 mm, such as 5-26 mm, for example 6-25 mm, such as 7-24 mm, e.g. 8-23 mm, such as 9-22 mm, for example 10-21 mm, e.g. 11-20 mm, such as 12-19 mm, for example 13-18 mm, e.g. 14-17 mm or 15-16 mm. However, in an alternative embodiment the protrusions and pad, are connected by means of hook-and-loop fastener, such as a Velcro® system.

In one embodiment of the polishing system according to the first aspect of the present invention, said first surface of the pad lock is provided with an adhesive, thereby improving the attachment to the moving pan.

These features relating to the pad lock provides for a sturdy and strong fixing of the various components while still ensuring that the system exhibits a certain degree of resilience thereby ensuring that the system is able to withstand the strong forces the different components is exposed to during the polishing process.

In one embodiment of the polishing system according to the first aspect of the present invention, the polishing discs used in the polishing system according to the invention comprise a first set of engagement means, and wherein the remainder of said system comprises a second set of engagement means, wherein said first set of engagement means are configured for entering into releasable engagement with said second set of engagement means, thereby allowing fastening said polishing discs to said fixing ring.

Said first and second set of engagement means may be any suitable engagement means, e.g. a bolt and nut—the only requirement being that said polishing disc in an easy and simple manner can be attached to the fixing ring.

In one embodiment of the polishing system according to the present invention, said first set of engagement means comprises fastening means in the form of one part of a hook-and-loop fastener, such as of one part of Velcro®, said first set of engagement means are provided at said first surface of said polishing discs, and wherein said second set of engagement means comprises fastening means in the form of the corresponding second part of a hook-and-loop fastener, such as of a second part of Velcro®, which is provided at said second surface of said fixing ring.

In one embodiment of the polishing system according to the first aspect of the present invention, said first set of engagement means comprises a threaded protrusion extending from a central part of said first surface of said polishing discs, and wherein said second set of engagement means comprises a threaded nut configured to be arranged at said first surface of said pad, and wherein said pad and said fixing ring are provided with a number of through-going holes for accommodating said threaded protrusion and optionally also part of said threaded nut, thereby enabling securing of said polishing discs to said pad and said fixing ring.

In one embodiment of the polishing system according to the first aspect of the present invention, said through-going holes at said second surface of said fixing ring is having a circular, or a non-circular shape, such as a triangular shape, a rectangular shape, such as a square shape, a hexagonal shape or an octagonal shape, and wherein said first surface of said polishing discs comprises a locking element protruding from said second surface of said polishing discs and having shape and dimensions so as to fit tightly into said through-going holes at said second surface of said fixing ring.

In one embodiment of the polishing system according to the first aspect of the present invention, said first set of engagement means comprises a threaded hole extending into central part of said first surface of said polishing discs, and wherein said second set of engagement means comprises a threaded bolt configured to be arranged at said first surface of said pad, and wherein said pad and said fixing ring are provided with a number of through-going holes for accommodating said threaded bolt, thereby enabling securing of said polishing discs to said pad and said fixing ring.

In one embodiment of the polishing system according to the first aspect of the present invention, said through-going holes at said second surface of said fixing ring is having a circular, or a non-circular shape, such as a triangular shape, a rectangular shape, such as a square shape, a hexagonal shape or an octagonal shape, and wherein said second surface of said polishing discs comprises a locking element protruding from said first surface of said polishing discs and surrounding said threaded hole, said locking element is having shape and dimensions so as to fit tightly into said through-going holes at said second surface of said fixing ring.

These embodiments relating to the polishing discs and the fixing thereof all provides for a strong and sturdy fixing of the polishing discs to the fixing ring and the rest of the system.

In one embodiment of the polishing system according to the first aspect of the present invention, each said connecting element is being configured for penetrating through-going stem holes in said pad lock, said pad and said fixing ring and also said moving pan which the system is to be fixed to, wherein each said connecting element comprises a first end, a second end, a locking means, and a stem extending between said first end and said second end, wherein said first end being configured to abut the second surface of said fixing ring; and wherein at least part of said stem is being configured to penetrate said through-going stem holes in said pad lock, said pad and said fixing ring and also said moving pan; and wherein said locking means are configured to prevent said stem from mowing out of said through-going stem holes.

In one embodiment of the polishing system according to the first aspect of the present invention, said first end of said connecting element comprises a flat element; and wherein said second end of said connecting element comprises a bar comprising a through-going clip hole; and wherein said stem comprising a flexible wire connecting said first end and said second end; and wherein said locking means comprises a clip configured to penetrate said through-going clip hole in said bar.

In one embodiment of the polishing system according to the first aspect of the present invention, said first end of said connecting element comprises a flat element; and wherein said second end of said connecting element comprises a threaded cylinder; and wherein said stem comprising a rod connecting said first end and said second end; and wherein said locking means comprises a nut, such as a winged nut configured to be screwed onto said threaded cylinder of said second end of said connecting element.

These embodiments relating to the connecting elements and the fixing thereof all provide for a strong and sturdy fixing of the various components of the system.

In a second aspect the present invention relates to a polishing tool for providing a polishing finish to a concrete surface, said polishing tool comprises a polishing system according to the first aspect of the present invention in combination with a moving pan of a powered machine.

In one embodiment of the polishing tool according to the second aspect of the present invention, said moving pan is a floating pan of a concrete finishing machine, such as a floor grinder or a power trowel.

In a third aspect the present invention relates to a powered polishing machine comprising a polishing system according to the first aspect of the present invention or comprising a polishing tool according to the second aspect of the present invention.

In a fourth aspect the present invention relates to a use of a polishing system according to the first aspect of the present invention, or of a polishing tool according to the second aspect of the present invention or of a powered polishing machine according to the third aspect of the present invention for providing a polished finish to a concrete surface.

BRIEF DESCRIPTION OF THE FIGURES

Referring now to the drawings for further illustration of the invention in its various aspects, FIG. 1 is a principle diagram illustrating in a side view the various components of the system of the invention and their mutual positions during use thereof in a polishing operation.

FIG. 1 shows a polishing system 100 for providing a polishing finish to a concrete surface. The system, in the orientation intended for use when polishing a horizontal surface of a concrete material, such as a floor, comprises from top to bottom: a pad lock 2, a pad 10, a fixing ring 18 and a number of polishing discs 24.

Figure 1:
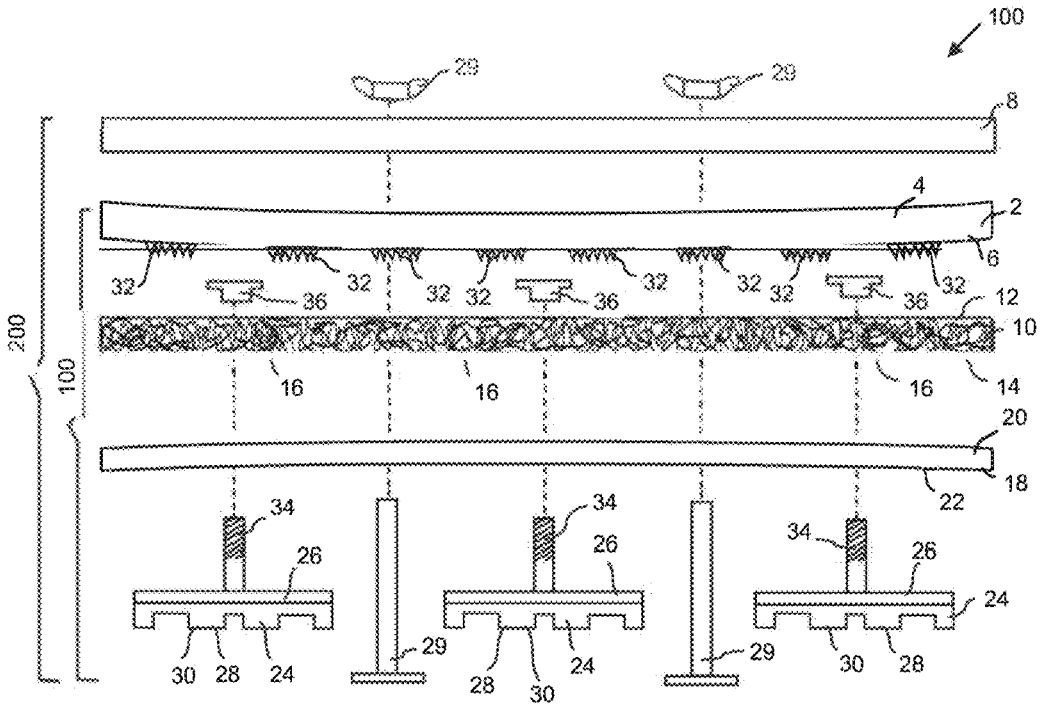
FIG. 1 is a side view of a principle diagram illustrating the various components of the system of the invention and their mutual positions during use thereof in a polishing operation.

The pad lock 2 comprises a first surface 4 and a second surface 6.

The pad lock, at the first surface thereof is configured for being connected to a moving pan 8. of a powered polishing machine.

The pad 10 comprises a first surface 12 and a second surface 14. The first surface is configured to be contacted to said second surface 6 of the pad lock 2.

The pad is being made of a resilient fibrous material comprising a number of voids 16 within its individual fibers. The voids are accessible from a first surface thereof;

The fixing ring 18 comprises a first surface 20 and a second surface 22.

The fixing ring is at a first surface thereof configured for being to be contacted with the second surface 14 of the pad 10. The fixing ring carries a number of polishing discs 24. Each polishing disc comprises a first surface 26 and a second surface 28. Each polishing discs at the second surface 28 comprises polishing means 30.

The system comprises in respect of each polishing disc 24 a first set of engagement means 34 which in FIG. 1 is exemplified as a threaded bolt extending from the first side thereof. A second set of engagement means 36 in the form of a nut is configured to enter into engagement with the first set of engagement means 34, thereby connecting the polishing dish, the fixing ring and the pad to each other.

The polishing system 100 of the invention illustrated in FIG. 1 furthermore comprises a number of connecting elements 29. These are in FIG. 1 exemplified as a bolt and nut configured to enter into engagement with each other so that the pad lock 2 and the pad 10 and the fixing ring 18 can be fixed to a moving pan 8 of powered polishing machine by penetrating through-going holes of the pad lock and said pad and said fixing ring.

In the polishing system of the present invention the pad lock 2 comprises, at least at a part of said second surface 6 thereof a number of protrusions 32 which are able to enter into engagement with the voids 16 accessible at the first surface 12 of said fibrous flexible pad 10. Thereby the integrity of the polishing system during use thereof in a polishing operation is secured.

Figure 2:
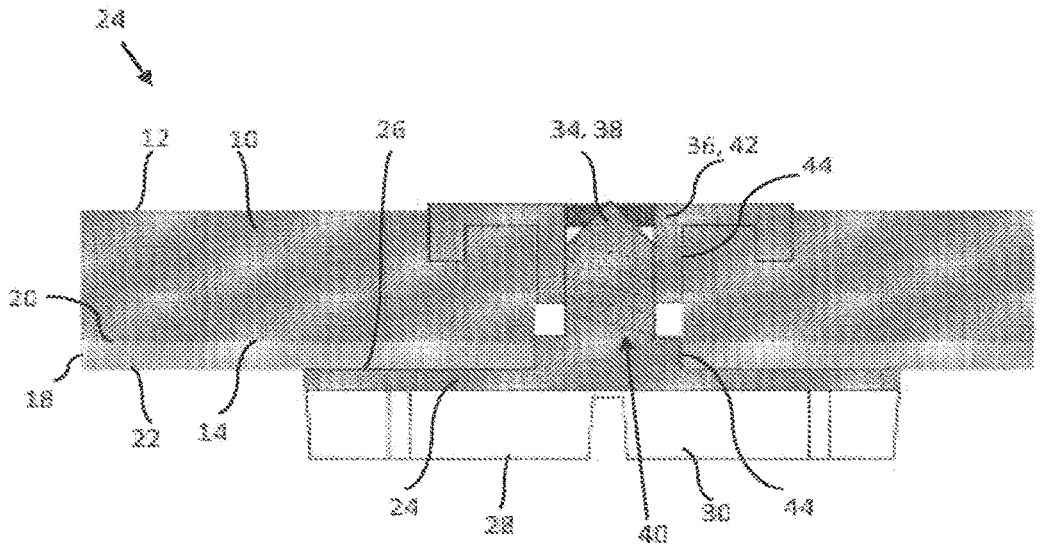
FIG. 2 is a cross-sectional view illustrating one embodiment of engagement means for securing polishing discs to the fixing ring of the polishing system of the invention.

FIG. 2 is a cross-sectional view illustrating one embodiment of engagement means for securing polishing discs to the fixing ring of the polishing system of the invention.

FIG. 2 shows the fixing ring 18 and the pad 10 of a polishing system according to the present invention. To the second side of 22 of the fixing ring is fastened a polishing disc 24. This is accomplished by letting the polishing discs 24 comprise a first set of engagement means 34 in the form of a threaded protrusion 38 extending from a central part 40 of the first surface 26 of the polishing disc 24. A second set of engagement means 36 in the form of a threaded nut 42 which is arranged at the first surface 12 of the pad 10 through a through-going hole 44 for accommodating said threaded protrusion 38 and also part of said threaded nut 42.

In this way the polishing disc 24 can be securely fixed to the pad 10 and said fixing ring 18.

Furthermore, this embodiment allows for easy and fast exchange of polishing discs in case these have become worn or in case another degree of coarseness is desired.

Figure 3:
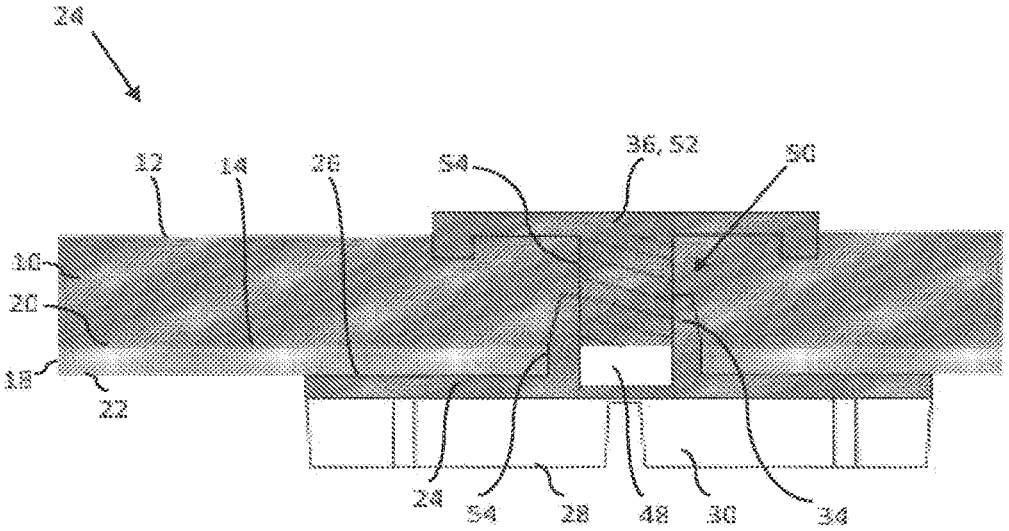
FIG. 3 is a cross-sectional view illustrating another embodiment of engagement means for securing polishing discs to the fixing ring of the polishing system of the invention.

FIG. 3 is a cross-sectional view illustrating another embodiment of engagement means for securing polishing discs to the fixing ring of the polishing system of the invention.

FIG. 3 shows the fixing ring 18 and the pad 10 of a polishing system according to the present invention. To the second side of 22 of the fixing ring is fastened a polishing disc 24. This is accomplished by letting the polishing discs 24 comprise a first set of engagement means 34 in the form of a threaded hole 48 extending into central part 50 of the first surface 26 of the polishing disc 24. A second set of engagement means 36 in the form of a threaded bolt 52 which is configured to be arranged at said first surface 12 of the pad 10 and configured to enter into engagement with the threaded hole 48. The pad 10 and said fixing ring 18 are provided with a number of through-going holes 54 for accommodating the threaded bolt 52 and the threaded hole 48 thereby enabling securing of the polishing disc 24 to the pad 10 and the fixing ring 18.

Figure 4:
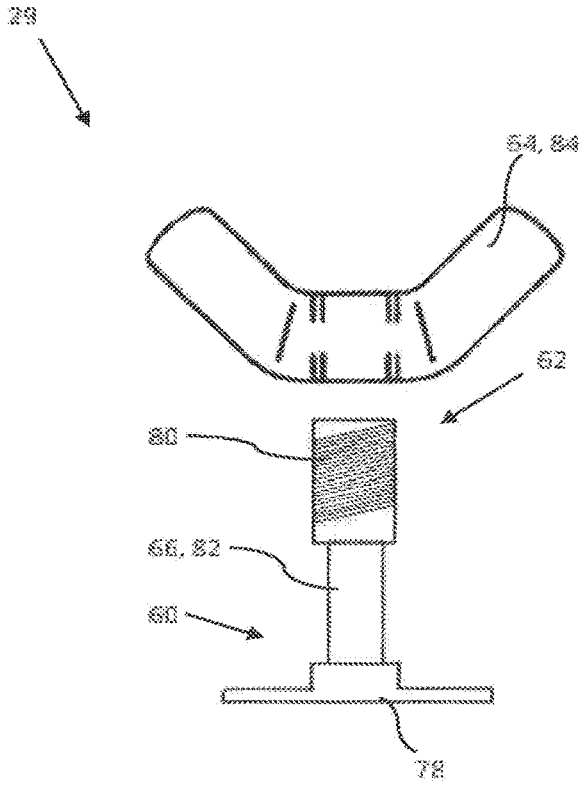
FIG. 4 is a side view illustrating one embodiment of a connection element for securing a fixing ring, a pad and a pad lock of the polishing system of the invention to a moving pan of a powered polishing machine.

FIG. 4 is a side view illustrating one embodiment of a connection element for securing a fixing ring, a pad and a pad lock of the polishing system of the invention to a moving pan of a powered polishing machine.

FIG. 4 shows a connecting element 29 comprises a first end 60, a second end 62, a locking means 64, and a stem 66 extending between the first end and the second end of the connecting element.

The first end 60 of the connecting element comprises a flat element 78 and the second end 62 of the connecting element 29 comprises a threaded cylinder 80.

The stem 66 comprising a rod 82 connecting the first end 60 and the second end 62.

The locking means 64 comprises a winged nut 84 which can be screwed onto the threaded cylinder 80 of the second end 62 of the connecting element 29.

At least part of the stem 66 is being configured to penetrate a through-going stem hole 58 in the pad lock 2, in the pad 10 and in the fixing ring 18 and also in the moving pan 8, thereby securing these components to each other.

Figure 5:
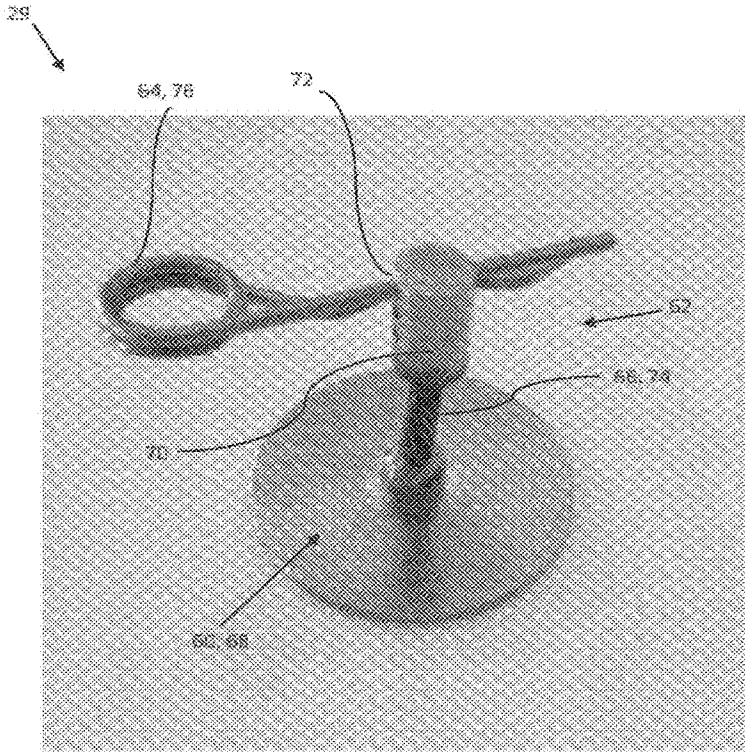
FIG. 5 is a perspective view illustrating another embodiment of connection elements for securing a fixing ring, a pad and a pad lock of the polishing system of the invention to a moving pan of a powered polishing machine.

FIG. 5 is a perspective view illustrating another embodiment of connection elements for securing a fixing ring, a pad and a pad lock of the polishing system of the invention to a moving pan of a powered polishing machine.

FIG. 5 shows a connecting element 29 comprises a first end 60, a second end 62, a locking means 64, and a stem 66 extending between the first end and the second end of the connecting element.

The first end 60 of the connecting element 29 comprises a flat element 68. The second end 62 of the connecting element 29 comprises a bar 70 comprising a through-going clip hole 72. The stem 66 in the form of a flexible wire 74 connecting the first end 60 and the second end 62. The locking means 64 comprises a clip 76 configured to penetrate the through-going clip hole 72 in the bar 70.

At least part of the stem 66 is being configured to penetrate a through-going stem hole 58 in the pad lock 2, in the pad 10 and in the fixing ring 18 and also in the moving pan 8, thereby securing these components to each other.

Modifications and combinations of the above principles and designs are foreseen within the scope of the present invention.

The invention claimed is:

1. A polishing system for providing a polishing finish to a concrete surface, said system, in the orientation intended for use when polishing a horizontal surface of a concrete material, such as a floor, comprising from top to bottom:

a pad lock comprising a first surface and a second surface; said pad lock, at said first surface, being configured for being connected to a moving pan of a powered polishing machine;

a pad comprising a first surface and a second surface, said first surface being configured to be contacted to said second surface of said pad lock, said pad being made of a resilient fibrous material comprising a number of voids accessible at the first surface thereof;

a fixing ring comprising a first surface and a second surface, said fixing ring, at a first surface thereof, being configured to be contacted with said second surface of said pad;

a number of polishing discs each having a first surface and a second surface;

wherein each said polishing discs at the first surface thereof is being configured for being connected to said fixing ring, at a second surface thereof; and wherein each polishing discs at the second surface thereof comprises polishing means;

wherein said pad lock comprises, at least at a part of said second surface thereof, a number of protrusions which are able to enter into engagement with said voids of said first surface of said pad for securing the integrity of said system during use thereof in a polishing operation, and wherein said first surface of said pad lock and said first surface of said fixing ring each are exhibiting a concave curvature; and wherein said second surface of said pad lock and said second surface of said fixing ring each are exhibiting a convex curvature.

2. A polishing system according to claim 1, wherein said system furthermore comprises a number of connecting elements which is/are configured for connecting said pad lock and said pad and said fixing ring to a moving pan of a powered polishing machine by penetrating through-going, holes of said pad lock and said pad and said fixing ring.

3. A polishing system according to claim 1, wherein said pad lock, said pad and said fixing ring each are having an outer perimeter defining a circle; preferably wherein said pad lock, said pad and said fixing ring each are having a perimeter defining a circle of essentially equal diameter.

4. A polishing system according to claim 1, wherein said pad lock is being manufactured from a material from the group comprising polypropylene and polyethylene.

5. A polishing system according to claim 1, wherein said pad is being manufactured from a material from the group comprising polyester, nylon, synthetic fibers and natural fibers.

6. A polishing system according to claim 1, wherein said fixing ring is being manufactured from a material from the group comprising polypropylene, polyethylene and EPDM (ethylene propylene diene monomer).

7. A polishing system according to claim 1, wherein said second surface of said polishing discs comprises a polymer having embedded therein a number of diamonds, such as industrial diamonds.

8. A polishing system according to claim 7, wherein said polymer having diamonds embedded therein is selected from the group comprising Bakelite, a copolymer powder, such as artificial metal powder; a metal alloy powder, such as iron alloy powder; such as iron alloy powder, copper alloy powder; or carbon alloy powder.

9. A polishing system according to claim 1, wherein the coarseness of said polishing discs is selected from the grit sizes P50-P6000, such as P100-P3000, for example P200-P1000, for example P300-P 600 or P400-P500.

10. A polishing system according to claim 1, wherein the number of protrusions of said pad lock, at said second surface thereof, is 100-20,000 or more, such as 500-15,000, for example 1,000-10,000, such as 2,000-5,000.

11. A polishing system according to claim 1, wherein said pad lock, at said second surface thereof, comprises distinct and separated areas each comprising said protrusions.

12. A polishing system according to claim 1, wherein said pad lock, at said second surface thereof, comprises said protrusions evenly distributed, at least at a part or at parts of said surface.

13. A polishing system according to claim 1, wherein said protrusions on said second surface of said pad lock are distributed in a circular pattern.

14. A polishing system according to claim 1, wherein the length of said protrusions of said pad lock, in a direction perpendicular to said second surface, independently is 1-30 mm, such as 2-29 mm, for example 3-28 mm, e.g. 4-27 mm, such as 5-26 mm, for example 6-25 mm, such as 7-24 mm, e.g. 8-23 mm, such as 9-22 mm, for example 10-21 mm, e.g. 11-20 mm, such as 12-19 mm, for example 13-18 mm, e.g. 14-17 mm or 15-16 mm.

15. A polishing system according to claim 1, wherein the first surface of the pad lock is provided with an adhesive.

16. A polishing system according to claim 1, wherein said polishing discs comprise a first set of engagement means, and wherein the remainder of said system comprises a second set of engagement means, wherein said first set of engagement means are configured for entering into releasable engagement with said second set of engagement means, thereby allowing fastening said polishing discs to said fixing ring.

17. A polishing system according to claim 16, wherein said first set of engagement means comprises fastening means in the form of one part of a hook-and-loop fastener, such as of one part of Velcro®, said first set of engagement means are provided at said first surface of said polishing discs, and wherein said second set of engagement means comprises fastening means in the form of the corresponding second part of a hook-and-loop fastener, such as of a second part of Velcro®, which is provided at said second surface of said fixing ring.

18. A polishing system according to claim 17, wherein said first set of engagement means comprises a threaded protrusion extending from a central part of said first surface of said polishing discs, and wherein said second set of engagement means comprises a threaded nut configured to be arranged at said first surface of said pad, and wherein said pad and said fixing ring are provided with a number of through-going holes for accommodating said threaded protrusion and optionally also part of said threaded nut, thereby enabling securing of said polishing discs to said pad and said fixing ring.

19. A polishing system according to claim 18, wherein said through-going holes at said second surface of said fixing ring is having a circular, or a non-circular shape, such as a triangular shape, a rectangular shape, such as a square shape, a hexagonal shape or an octagonal shape, and wherein said first surface of said polishing discs comprises a locking element protruding from said second surface of said polishing discs and having shape and dimensions so as to fit tightly into said through-going holes at said second surface of said fixing ring.

20. A polishing system according to claim 16, wherein said first set of engagement means comprises a threaded hole extending into central part of said first surface of said polishing discs, and wherein said second set of engagement means comprises a threaded bolt configured to be arranged at said first surface of said pad, and wherein said pad and said fixing ring are provided with a number of through-going holes for accommodating said threaded bolt, thereby enabling securing of said polishing discs to said pad and said fixing ring.

21. A polishing system according to claim 20, wherein said through-going holes at said second surface of said fixing ring is having a circular, or a non-circular shape, such as a triangular shape, a rectangular shape, such as a square shape, a hexagonal shape or an octagonal shape, and wherein said second surface of said polishing discs comprises a locking element protruding from said first surface of said polishing discs and surrounding said threaded hole; said locking element is having shape and dimensions so as to fit tightly into said through-going holes at said second surface of said fixing ring.

22. A polishing system according to claim 2, wherein each connecting element is being configured for penetrating through-going stem holes in said pad lock; said pad and said fixing ring and also said moving pan which the system is to be fixed to, wherein each said connecting element comprises a first end, a second end, a locking means, and a stem extending between said first end and said second end, wherein said first end being configured to abut the second surface of said fixing ring; and wherein at least part of said stem is being configured to penetrate said through-going stem holes in said pad lock, said pad and said fixing ring and also said moving pan; and wherein said locking means are configured to prevent said stem from mowing out of said through-going stem holes.

23. A polishing system according to claim 22, wherein said first end of said connecting element comprises a flat element; and wherein said second end of said connecting element comprises a bar comprising a through-going clip hole; and wherein said stem comprising a flexible wire connecting said first end and said second end; and wherein said locking means comprises a clip configured to penetrate said through-going clip hole in said bar.

24. A polishing system according to claim 23, wherein said first end of said connecting element comprises a flat element; and wherein said second end of said connecting element comprises a threaded cylinder; and wherein said stem comprising a rod connecting said first end and said second end; and wherein said locking means comprises a nut, such as a winged nut configured to be screwed onto said threaded cylinder of said second end of said connecting element.

25. A polishing tool for providing a polishing finish to a concrete surface, said polishing tool comprises a polishing system according to claim 1 in combination with a moving pan of a powered machine.

26. A polishing tool according to claim 25, wherein said moving pan is a floating pan of a concrete finishing machine, such as a floor grinder or a power trowel.

27. A powered polishing machine comprising a polishing system according to claim 1.

28. Use of a polishing system according to claim 1 for providing a polished finish to a concrete surface.

* * * * *